US006634122B1

(12) United States Patent
Vermeulen et al.

(10) Patent No.: US 6,634,122 B1
(45) Date of Patent: Oct. 21, 2003

(54) CYLINDER MOUNTING ASSEMBLY FOR TRUCK MOUNTED SCRAPER BLADE

(75) Inventors: David M. Vermeulen, Vicksburg, MI (US); Bruce A. Helder, Grand Rapids, MI (US)

(73) Assignee: Root Spring Scraper Co., Kalamazoo, MI (US)

( * ) Notice: Subject to any disclaimer, the term of this patent is extended or adjusted under 35 U.S.C. 154(b) by 0 days.

(21) Appl. No.: 10/282,858

(22) Filed: Oct. 29, 2002

Related U.S. Application Data

(60) Provisional application No. 60/369,910, filed on Apr. 4, 2002.

(51) Int. Cl.[7] ..... E01H 5/04

(52) U.S. Cl. ..... 37/234; 37/236; 37/466; 37/195; 403/15; 403/24; 403/36; 403/37

(58) Field of Search ..... 37/231, 232, 234–236, 37/466, 195; 267/34; 403/15, 11, 24, 25, 36, 37, 34, 35, 300

(56) References Cited

U.S. PATENT DOCUMENTS 3,086,303 A 4/1963 Weeks

*Primary Examiner*—Christopher J. Novosad
(74) *Attorney, Agent, or Firm*—Flynn, Thiel, Boutell & Tanis, P.C.

(57) ABSTRACT

An improved hydraulic cylinder construction having a feature thereon facilitating operative connection with a service kit to enable a quick and injury free removal thereof from a location whereat the hydraulic cylinder is spring biased in a shock absorber installation, particularly for use in a scraper blade mounting assembly.

8 Claims, 5 Drawing Sheets

39
59
57
38
36
43
44
45
50
41
37
47
46
48
49
42
29
34
28
27
40
31
32
26
33
67
60
66
62
64
63

Fig 5
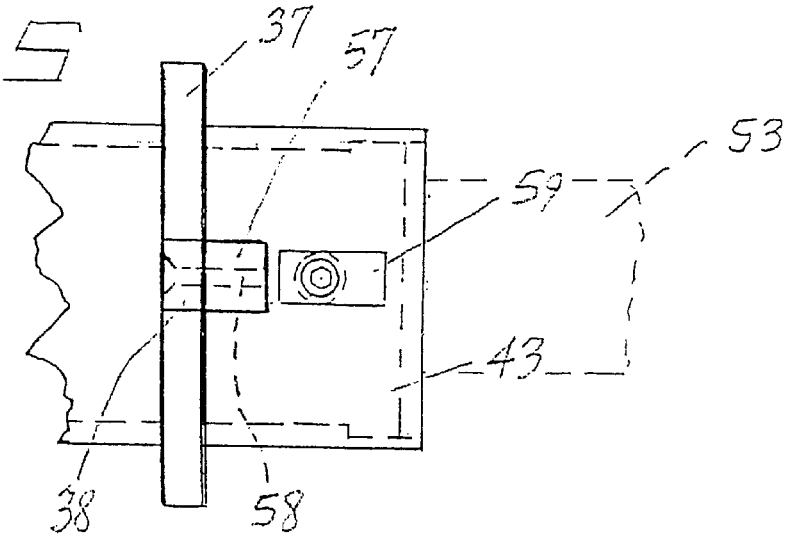
Fig 6
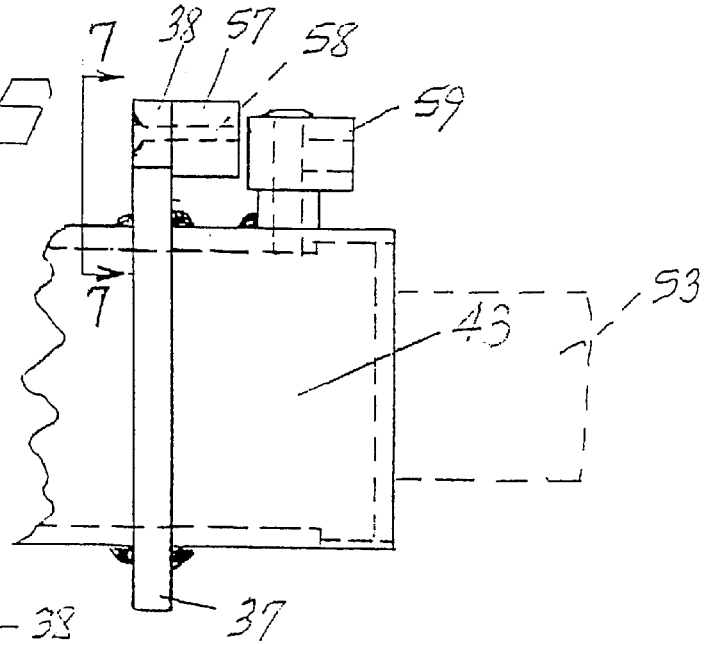
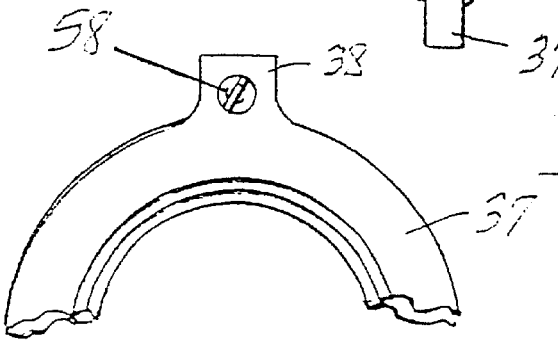
Fig 7

CYLINDER MOUNTING ASSEMBLY FOR TRUCK MOUNTED SCRAPER BLADE

This application claims the benefit of Provisional Application No. 60/369,910 filed Apr. 4, 2002.

FIELD OF THE INVENTION

This invention relates to an improved hydraulic cylinder construction and, more particularly, to a cylinder construction for use on a snow scraper blade mounting for trucks and a service kit therefor.

BACKGROUND OF THE INVENTION

This invention arose out of a need to minimize the down time involved in repairing a hydraulic cylinder mounted on a truck for use in controlling the elevation of a snow scraper blade. A typical hydraulic cylinder mounting is disclosed in U.S. Pat. No. 3 086 303. The subject matter of this patent is to be incorporated herein by reference. The difficulty in gaining access to the hydraulic cylinder after it, along with the spring housing, has been removed from the truck is to effect a compressing of the spring in order to facilitate removal of the nuts and bolts limiting the downward travel of the hydraulic cylinder within the spring housing. Since the spring is large and the spring force is also large, there is a risk of injury if the spring compression activity is not carefully controlled while the travel limiting nuts and bolts are removed.

Accordingly, it is an object of this invention to provide a hydraulic cylinder mounting assembly which can be easily assembled and disassembled from a truck as well as easily accessing the hydraulic cylinder to facilitate a repair thereto or replacement thereof.

It is a further object of the invention to provide a service kit for facilitating removal of the hydraulic cylinder from the spring housing.

It is a further object of the invention to provide a service kit, as aforesaid, wherein the force of the spring is overcome to enable the hydraulic cylinder to be removed from the spring housing.

It is a further object of the invention to provide a service kit, as aforesaid, which is easy to use and is not dangerous to the user while it is in use.

SUMMARY OF THE INVENTION

The objects and purposes of the invention are met by providing a hydraulic cylinder and a service kit therefor for facilitating removal of the hydraulic cylinder from the spring housing. The service kit is usable in association with a hydraulic cylinder having a cylinder housing, and an elongate piston rod reciprocal in the cylindrical housing and a spring abutment collar adjacent a first end from which projects the piston rod. The hydraulic cylinder is mounted in a spring housing which is open at opposite ends while simultaneously providing a spring abutment at a second and remote from a third end whereat the piston rod projects from the spring housing. A stop ring encircles the hydraulic cylinder adjacent the first end and is secured to the spring housing adjacent the third end. A spring is oriented in a compressed state between and engaging the spring abutment collar and the spring abutment to continually urge the cylinder housing and the spring abutment collar thereon toward the stop ring. The cylinder housing has a fluid connection at a fourth end remote from the first end. The hydraulic cylinder additionally includes an opening having a first internal thread therein. The service kit includes a coupling member having a first external thread at one end and an enlarged head at the other end. The first external thread is configured to threadedly couple directly to the first internal thread. The service kit also includes an abutment member which has a hole therethrough configured to loosely receive therethrough the first external thread but preventing the enlarged head from passing therethrough.

BRIEF DESCRIPTION OF THE DRAWINGS

FIG. 5 is a top of view of a fragment of the hydraulic cylinder housing adjacent the end from which the piston rod extends;

FIG. 6 is a side view of FIG. 5; and

FIG. 7 is a sectional view taken along the line 7—7 of FIG. 6.

DETAILED DESCRIPTION

Figure 1:
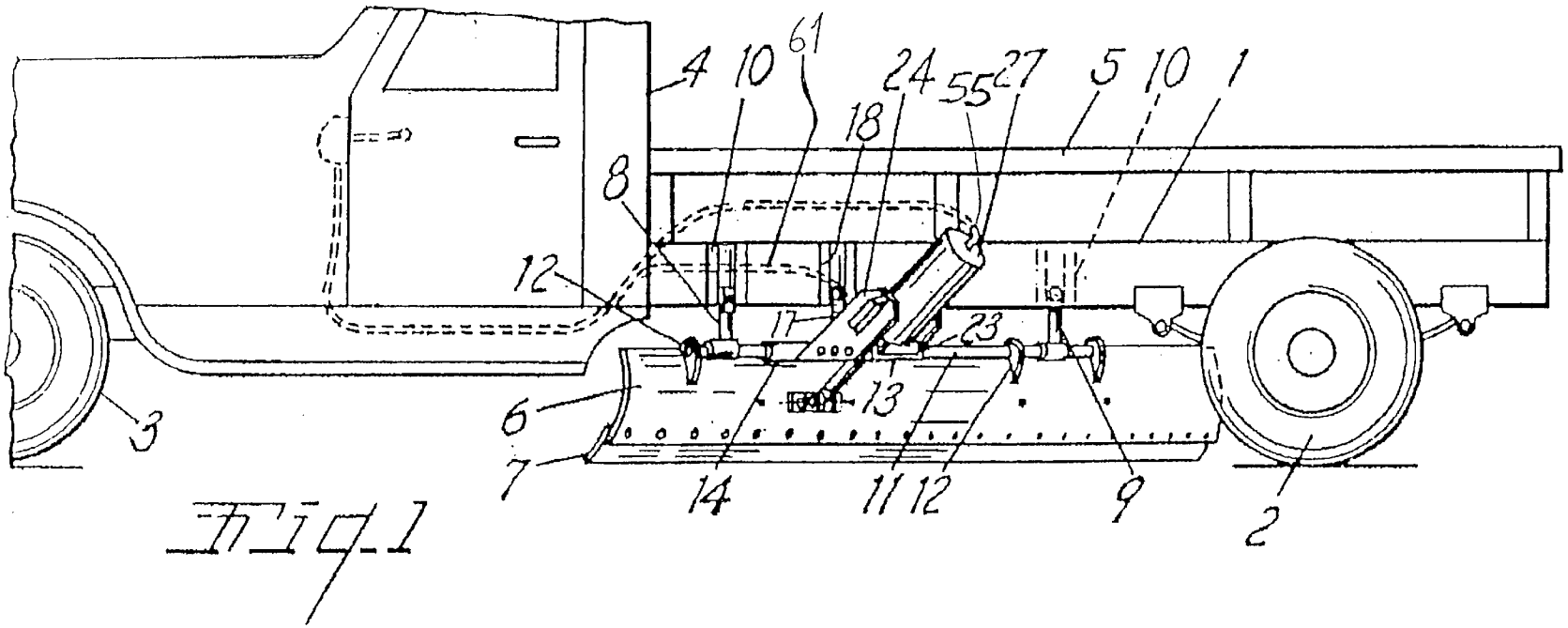
FIG. 1 is a side elevational view of a highway truck with a snow scraper blade mounted in operative position thereon by means of mounting connections.

FIG. 1 illustrates a conventional highway maintenance truck having a frame 1, rear driving wheels 2 and front wheels 3 with the usual operator's cab 4 and bed 5. An elongate snow scraper blade 6 having a wearing edge plate 7 is mounted obliquely across the underside of the frame 1 by means of a pair of upright mounting posts 8 and 9 secured to the side frame members by identical brackets 10. The posts 8 and 9 rigidly support a hinge shaft 11 from which the scraper blade is pivotally supported by means of knuckle plates 12 secured to the back side of the blade a the upper edge thereof.

An adjusting cylinder support bracket 13 of a channel shaped cross section is provided with a sleeve 14 on its forward end supported upon the hinge shaft 11 so that the bracket projects perpendicularly to the hinge shaft and obliquely to the frame of the truck. Spaced rightwardly (FIG. 2) from the sleeve 14 the web of the channel bracket 13 defines a transverse slot 15 adjustably receiving a clamp screw 16 which clamps the lower end of a third cylindrical support post 17 to the bracket 13. The post 17 projects upwardly and is fixedly secured in a third mounting bracket 18 secured to the side frame member 1 of the truck. The third mounting bracket 18 may be identical to the previously described brackets 10.

Toward the rear end of the mounting bracket 13, the side flanges 23 of the channel shaped bracket have upwardly and rearwardly inclined trunnion plates 24 secured thereto with inwardly projecting male trunnion bearings 25 near their upper ends. The bearings 25 coact with and pivotally support the female trunnion bearings 26 projecting transversely from a cylindrical spring housing 27. The lower left end 28 of the spring housing 27 is open and is axially slotted as at 29 (FIG. 3) on its upper side. The upper right end 31 of the spring housing 27 defines a center hole 32 for a fluid connection surrounded by an annular spring abutment 33. A short length of angle iron 34 is welded over the slot 29 to protect the slot and restore the strength of the cylinder housing 27.

Figure 4:
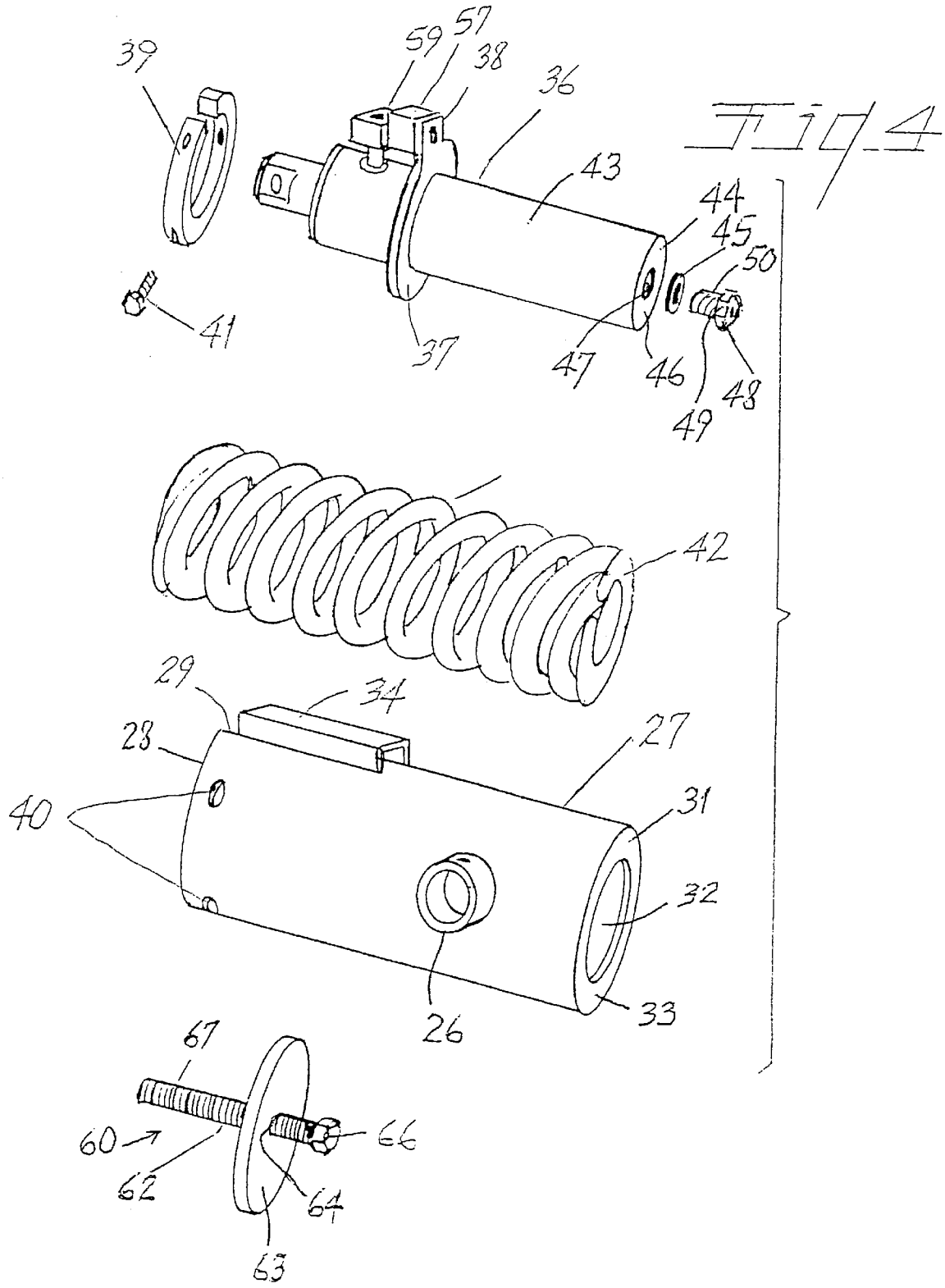
FIG. 4 is an exploded isometric view of the hydraulic cylinder and spring housing assembly.

Centrally and reciprocally within the spring housing 27 is inner hydraulic cylinder 36 substantially smaller than the spring housing 27 and having an annular abutment 37 projecting outwardly adjacent its lower left end. An ear on the annular abutment 37 projects into the slot 29 to prevent rotation of the hydraulic cylinder while permitting axial movement of the hydraulic cylinder. A split ring stop 39 is received in the lower end 28 of the spring housing 27 and is secured thereto by a plurality of bolts 41 (FIG. 4) received in tapped holes 40. A heavy compression spring 42 is positioned within the spring housing 27 and bears between the abutments 33 and 37.

The hydraulic cylinder 36 includes a cylindrical body 43 having at its upper right end 44 a relatively thick end plate 46 (FIG. 3) closing off the upper end of the cylindrical body 43. The end plate 46 has an internally threaded opening 47 extending therethrough. A bolt 48 having an enlarged head 49 at one end and an external thread 50 at the other upper right end configured so that the external thread 50 is threadedly received directly into the internally threaded opening 47. A lock washer 45 can be provided if desired. The bolt 48 has a central passageway 51 therethrough with the upper right end of the passageway 51 located within the enlarged head of the bolt 48 being internally threaded as at 54 and configured to receive a fluid connection member 55 (FIG. 1) therein.

Figure 2:
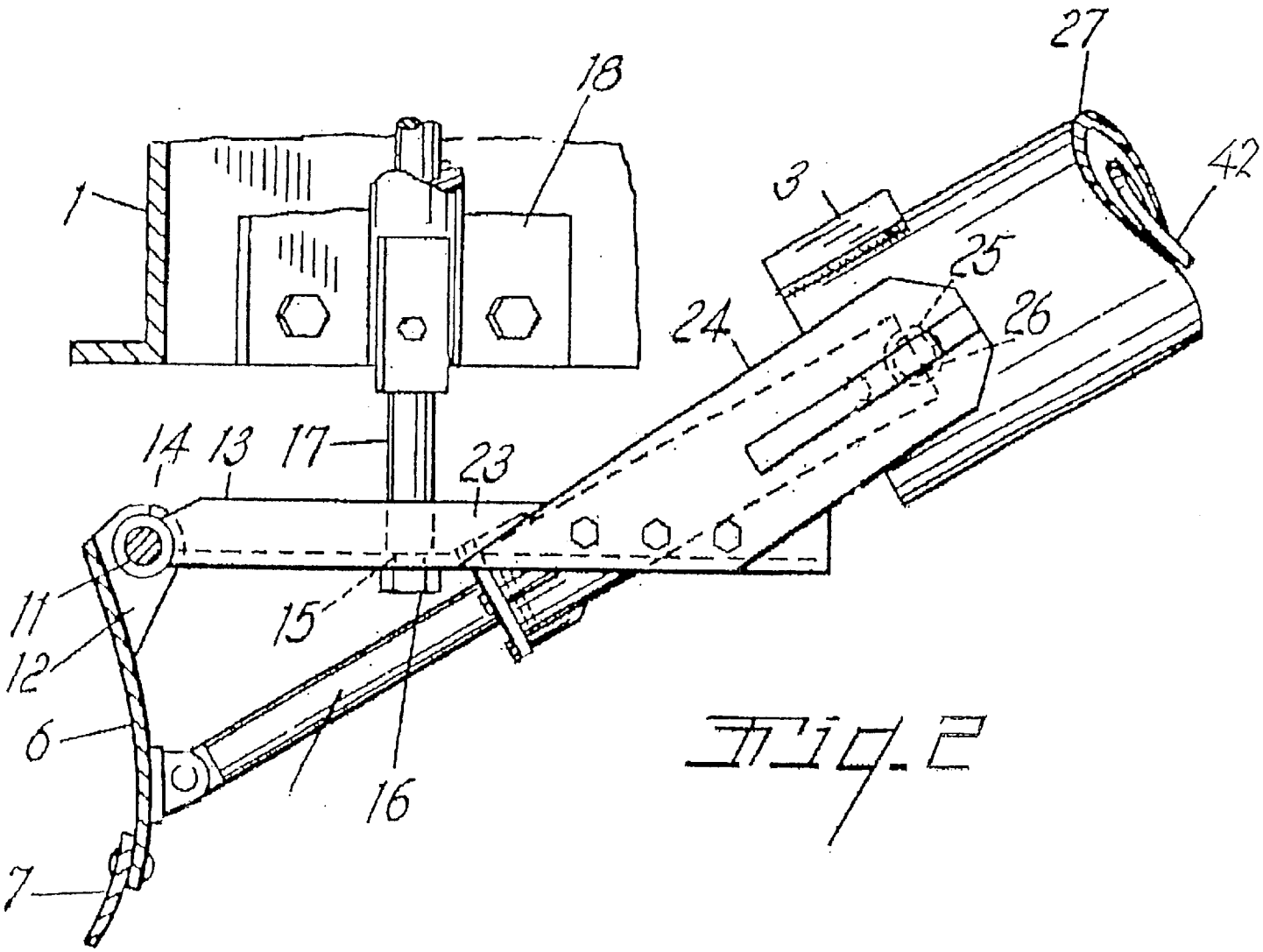
FIG. 2 is an enlarged side view of a conventional support mechanism for the spring housing.

A piston to 52 is reciprocally mounted within the cylindrical body 43. A cylinder rod 53 is fixedly secured to the piston 52 and is movable therewith. The distal end of the piston rod at 52 is configured to be secured to the snow scraper blade 6 in a conventional manner as depicted in FIG. 2.

The cylindrical body 43 additionally has a fluid inlet port 59 adjacent the lower left end thereof The inlet port 59 is configured for connection to fluid supply as at 61 (FIG. 1).

In this particular embodiment, the ear 38 has a wear piece 57 fastened thereto by a screw 58. The wear piece 57 is configured to slidably engage the angle iron 34 and protect the ear 38 from wear as well as assure alignment of the inlet port 59 with the slot 29.

Figure 3:
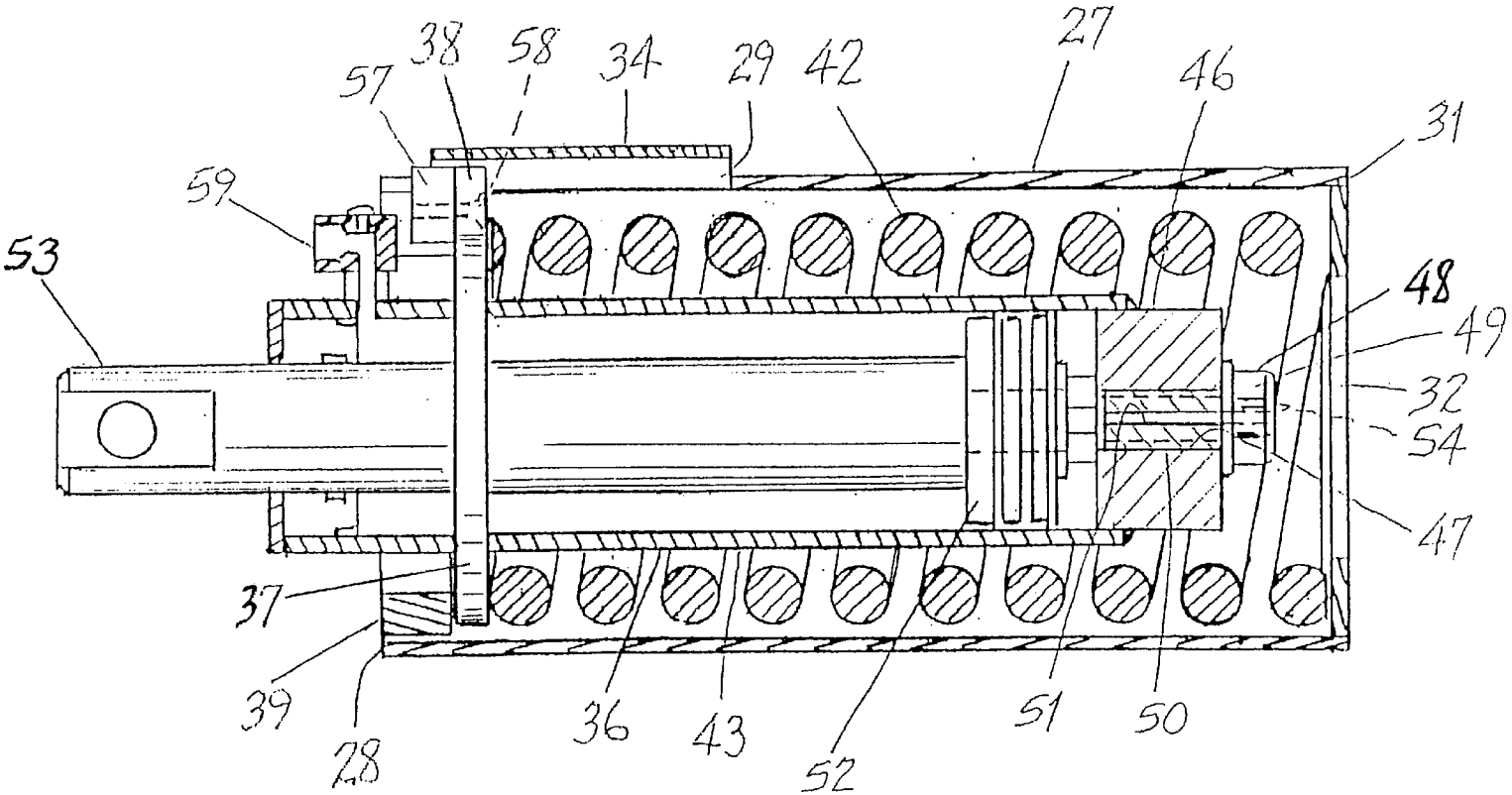
FIG. 3 is a cross sectional view through the longitudinal center of the inventive hydraulic cylinder and spring housing mount therefor.

In order to disassemble the assembly illustrated in FIG. 3, a service kit 60 consisting of an elongate bolt 62 (FIG. 4) in combination with a disk or plate 63 is provided, the plate 63 having a central hole 64 therethrough the diameter of which is smaller than the enlarged head 66 on the bolt 62. The external thread 67 on the bolt 62 is configured to directly threadedly engage the internally threaded opening 47. First, however, the bolt 48 must be removed from the internally threaded opening 47. This will also necessitate the removal of all of the fluid connection lines that are coupled to the hydraulic cylinder 36. Thereafter, the bolt 62 is oriented so that the threaded end 67 thereof is inserted through the central hole 64 in the plate 63. The threaded end 67 of the bolt 62 is then inserted into the internally threaded opening 47. The length of the bolt 62 is sufficiently long that several turns thereof are required before the head end 66 engages the plate 63. Once the head end 66 engages the plate 63, continued rotation thereof is to occur and the end plate 46 will be drawn toward the plate 63 to compress the spring 42 and draw the annular spring abutment collar 37 away from the split ring 39. Thereafter, the bolts 41 can be removed so that the split ring 39 can be removed from the spring housing 27. An this time, the bolt 62 can be rotated in the opposite direction so that the end plate 46 and the hydraulic cylinder 36 are driven away from the plate 63 and the annular spring 33. The bolt 62 is sufficiently long to facilitate a total relaxation of the spring 42 before the thread 67 thereof disengages from the thread 47. After the bolt 62 has exited from the internally threaded opening 47, the hydraulic cylinder 36 can be drawn out of the spring housing 27 at the left end of the spring housing 27 for replacement and/or servicing.

In order to install a repaired or new hydraulic cylinder 36 into the spring housing 27, one need only reverse the procedure described above.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a scraper blade mounting on a truck having frame members comprising a pivotal support arranged at an angle to said frame members and supported therebelow, a scraper blade pivotally mounted on said pivotal support, an operating cylinder support bracket fixedly supported from the frame of said truck, spaced trunnion bearings carried by said support bracket, a spring housing having trunnion bearings transverse to an axis thereof pivotally supported by the trunnion bearings on said bracket and having a first annular abutment at one end, a hydraulic cylinder positioned in spaced relation within said spring housing and having a piston rod reciprocable in said hydraulic cylinder, and means pivotally connecting said piston rod to said scraper blade, said hydraulic cylinder additionally having a second annular abutment spaced from said first annular abutment and being axially slidable and non-rotatively engaged with said spring housing, a compression spring bearing between said first annular abutment on said spring housing and said second annular abutment on said hydraulic cylinder, said hydraulic cylinder having at least one fluid connection at an end adjacent said first annular abutment, wherein the improvement comprises in combination:

(a) said fluid connection is defined by a first internally threaded opening in said hydraulic cylinder through which hydraulic fluid is supplied;

(b) a service kit comprising a first coupling member having a first external thread threadedly coupled to the thread of said first internally threaded opening and having an axially extending bore therethrough with at least a portion of said bore having a second internal thread configured to provide a connection to a fluid system;

(c) a second coupling member having a second external thread and an enlarged head at one end thereof, said second external thread being configured identically to said first external thread; and (d) a plate-like member having a guide hole therethrough configured to loosely receive therethrough said second external thread and prevent said enlarged head from passing therethrough.

2. In a fluid cylinder assembly, comprising, an operating fluid cylinder having a cylinder housing, an elongate piston rod reciprocal in said cylinder housing and a spring abutment collar adjacent a first end from which projects said piston rod, a spring housing into which is housed said operating fluid cylinder, said spring housing being open at opposite ends while simultaneously providing a spring abutment at a second end remote from a third end thereof whereat said piston rod projects from said spring housing, a stop encircling said cylinder housing adjacent said first end thereof and being secured to said spring housing adjacent said third end thereof, a spring oriented in a compressed state between and engaging said spring abutment collar and said spring abutment to continually urge said cylinder housing and said spring abutment collar thereon toward said stop, said cylinder housing having at least one fluid connection at a fourth end remote from said first end, wherein the improvement comprises in combination:

(a) said fluid connection is defined by a first internally threaded opening in said hydraulic cylinder;

(b) a service kit comprising a first coupling member having a first external thread threadedly coupled to the thread of said first internally threaded opening and having an axially extending bore therethrough with at least a portion of said bore having a second internal thread configured to provide a connection to a fluid system;

(c) a second coupling member having a second external thread and an enlarged head at one end thereof, said second external thread being configured identically to said first external thread; and (d) a plate-like member having a guide hole therethrough configured to loosely receive therethrough said second external thread and prevent said enlarged head from passing therethrough.

3. A service kit for facilitating access to a fluid cylinder assembly, comprising, an operating fluid cylinder having a cylinder housing, an elongate piston rod reciprocal in said cylinder housing and a spring abutment collar adjacent a first end from which projects said piston rod, a spring housing into which is housed said operating fluid cylinder, said spring housing being open at opposite ends while simultaneously providing a spring abutment at a second end remote from a third end thereof whereat said piston rod projects from said spring housing, a stop encircling said housing adjacent said first end thereof and being secured to said spring housing adjacent said third end thereof, a spring oriented in a compressed state between and engaging said spring abutment collar and said spring abutment to continually urge said cylinder housing and said spring abutment collar thereon toward said stop, said cylinder housing having at least one fluid connection at a fourth end remote from said first end, said fluid connection including an opening in said hydraulic cylinder, said opening having a first internal thread, said service kit comprising:

a coupling member having a first external thread and an enlarged head at one end thereof, said first external thread being configured to threadedly coupled to said first internal thread; and a plate-like member having a hole therethrough configured to loosely receive therethrough said second external thread and prevent said enlarged head from passing therethrough.

4. The service kit according to claim 3, wherein said fluid connection includes a fluid coupling member having a second external thread configured to couple to said first internal thread, said fluid coupling member having an axially extending bore therethrough with at least a portion of said bore having a second internal thread configured to provide a connection to a fluid system.

5. The service kit according to claim 4, wherein said plate-like member is of a size larger than the cross Section of said spring housing.

6. The service kit according to claim 4, wherein a length of said coupling member is greater then the length that said spring is operatively compressed between said spring abutment collar and said spring abutment with no load applied to said piston rod.

7. A method for accessing a hydraulic cylinder in a fluid cylinder assembly, comprising, an operating fluid cylinder having a cylinder housing, an elongate piston rod reciprocal in said cylinder housing and a spring abutment collar adjacent a first end from which projects said piston rod, a spring housing into which is housed said operating fluid cylinder, said spring housing being open at opposite ends while simultaneously providing a spring abutment at a second end remote from a third end thereof whereat said piston rod projects from said spring housing, a stop encircling said cylinder housing adjacent said first end thereof and being secured to said spring housing adjacent said third end thereof, a spring oriented in a compressed state between and engaging said spring abutment collar and said spring abutment to continually urge said cylinder housing and said spring abutment collar thereon toward said stop, said cylinder housing having at least one fluid connection at a fourth end remote from said first end, said fluid connection including an opening in said hydraulic cylinder, said opening having a first internal thread, comprising the steps of:

placing a coupling member having a first external thread and an enlarged head at one end thereof through a hole in plate-like member and effecting a threaded coupling of said first external thread with said first internal thread, orienting said plate-like member against said spring housing and drawing by operation of said coupling member in a first direction of rotation said hydraulic cylinder toward said plate-like member to further compress said spring and draw said spring abutment collar away from said stop, unsecuring and removing said stop from said spring housing, operating said coupling member in a second direction of rotation to effect movement of said hydraulic cylinder away from said plate-like member to reduce the compression of said spring entirely to facilitate removal of said hydraulic cylinder from said spring housing after disengagement of said first external thread from said first internal thread.

8. The method according to claim 7, wherein said coupling member has a length greater than the length that said spring is operatively compressed between said spring abutment collar and said spring abutment with no load applied to said piston rod.

* * * * *